US007597152B2

(12) United States Patent
Wood et al.

(10) Patent No.: US 7,597,152 B2
(45) Date of Patent: Oct. 6, 2009

(54) SWELLING LAYER INFLATABLE

(75) Inventors: Edward T. Wood, Kingwood, TX (US); Gregory C. Badke, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/955,650

(22) Filed: Dec. 13, 2007

(65) Prior Publication Data

US 2008/0087441 A1 Apr. 17, 2008

Related U.S. Application Data

(63) Continuation of application No. 10/995,593, filed on Nov. 22, 2004, now abandoned.

(60) Provisional application No. 60/525,019, filed on Nov. 25, 2003.

(51) Int. Cl.
*E21B 33/127* (2006.01)

(52) U.S. Cl. ..... 166/387; 166/187; 166/179; 277/333; 277/934

(58) Field of Classification Search ..... 166/187, 166/179, 387; 277/331–334, 646, 934
See application file for complete search history.

(56) References Cited

U.S. PATENT DOCUMENTS

| | | | | |
|---|---|---|---|---|
| 2,849,070 | A | 8/1958 | Maly | |
| 2,942,668 | A | 6/1960 | Maly et al. | |
| 2,945,541 | A | 7/1960 | Maly et al. | |
| 2,981,332 | A | 4/1961 | Miller et al. | |
| 2,981,333 | A | 4/1961 | Miller et al. | |
| 3,099,318 | A | 7/1963 | Miller et al. | |
| 3,385,367 | A | 5/1968 | Kollsman | |
| 3,477,506 | A | 11/1969 | Malone | |
| 4,262,744 | A | 4/1981 | Mitchell et al. | |
| 4,862,967 | A | 9/1989 | Harris | |
| 4,889,199 | A * | 12/1989 | Lee | 175/317 |
| 4,897,139 | A | 1/1990 | Wood | |
| 4,967,846 | A | 11/1990 | Wood | |

(Continued)

FOREIGN PATENT DOCUMENTS

| | | | |
|---|---|---|---|
| GB | 2347446 | A | 9/2000 |

(Continued)

OTHER PUBLICATIONS

Freyer, Rune, et al., "Swelling Packer for Zonal Isolation in Open Hole Screen Completions", SPE 78312, Oct. 2002, 1-5.

(Continued)

*Primary Examiner*—Shane Bomar
(74) *Attorney, Agent, or Firm*—Steve Rosenblatt

(57) ABSTRACT

An inflatable features a swelling layer. The swelling layer can be made integral or attached to the element or it can be bonded or otherwise secured to the mandrel. Upon inflation with fluid, the element expands into sealing contact with a surrounding tubular or wellbore. The fluid is absorbed or otherwise interacts with the swelling layer so that, in a preferred embodiment, the total occupied volume of the swelling layer and fluid individually is retained after mixing with the swelling of the layer acting to hold the seal of the inflatable element even if a problem develops in the sealing element.

20 Claims, 3 Drawing Sheets

U.S. PATENT DOCUMENTS

| | | | | |
|---|---|---|---|---|
| 5,048,605 | A | 9/1991 | Toon et al. | |
| 5,195,583 | A | 3/1993 | Toon et al. | |
| 5,271,469 | A | 12/1993 | Brooks et al. | |
| 5,667,011 | A | 9/1997 | Song et al. | |
| 5,738,171 | A | 4/1998 | Szarka | |
| 5,901,789 | A | 5/1999 | Donnelly et al. | |
| 6,012,522 | A | 1/2000 | Donnelly et al. | |
| 6,073,692 | A * | 6/2000 | Wood et al. | 166/187 |
| 6,213,209 | B1 | 4/2001 | Nguyen et al. | |
| 6,250,385 | B1 | 6/2001 | Montaron | |
| 6,253,850 | B1 | 7/2001 | Nazzai et al. | |
| 6,263,966 | B1 | 7/2001 | Haut et al. | |
| 6,302,207 | B1 | 10/2001 | Nguyen et al. | |
| 6,431,282 | B1 | 8/2002 | Bosma et al. | |
| 6,530,431 | B1 | 3/2003 | Castano-Mears et al. | |
| 6,543,545 | B1 | 4/2003 | Chatterji et al. | |
| 6,595,283 | B1 | 7/2003 | Turley et al. | |
| 6,668,928 | B2 | 12/2003 | Brothers | |
| 6,769,484 | B2 | 8/2004 | Longmore | |
| 6,834,727 | B2 | 12/2004 | Wills et al. | |
| 6,938,698 | B2 | 9/2005 | Coronado | |
| 6,976,542 | B2 * | 12/2005 | Henriksen et al. | 166/386 |
| 7,422,071 | B2 * | 9/2008 | Wilkie et al. | 166/387 |
| 2002/0084070 | A1 | 7/2002 | Voll et al. | |
| 2003/0075323 | A1 | 4/2003 | Vercaemer et al. | |
| 2003/0136562 | A1 | 7/2003 | Robison et al. | |
| 2003/0196820 | A1 | 10/2003 | Patel | |
| 2004/0020662 | A1 | 2/2004 | Freyer | |
| 2004/0055760 | A1 | 3/2004 | Nguyen | |
| 2004/0112609 | A1 | 6/2004 | Whanger et al. | |
| 2004/0164499 | A1 | 8/2004 | Murakami et al. | |
| 2005/0171248 | A1 | 8/2005 | Li et al. | |

FOREIGN PATENT DOCUMENTS

| | | |
|---|---|---|
| WO | 0039432 | 7/2000 |
| WO | 0061814 | 10/2000 |
| WO | 02059452 A1 | 8/2002 |

OTHER PUBLICATIONS

Antonio, Luiz, et al., "Swelling Packer Technology Eliminates Problems in Difficult Zonal Isolation in Tight-Gas Reservoir Completion", SPE 107578, Apr. 2007, 1-4.

Al-Yami, A.S., et al., "Investigation of Water-Swelling Packers", SPE 114814, Jun. 2008, 1-11.

* cited by examiner

SWELLING LAYER INFLATABLE

PRIORITY INFORMATION

This application is a continuation application claiming priority from U.S. patent application Ser. No. 10/995,593, filed on Nov. 22, 2004, now abandoned, which claims the benefit of U.S. Provisional Application No. 60/525,019 filed Nov. 25, 2003.

FIELD OF THE INVENTION

The field of this invention is inflatable packers or bridge plugs and more particularly those that retain a seal after inflation despite an element failure or changes in downhole conditions.

BACKGROUND OF THE INVENTION

Inflatable packers typically comprise a flexible element mounted on a mandrel with one stationary collar and one movable collar at an opposite end. Typically a system of valves is used to get pressurized fluid into the annular space between the mandrel and the element to start the inflation process. The inflation allows the element to expand radially into sealing contact with a surrounding tubular or wellbore, made possible by the movable collar riding up toward the stationary collar, which is usually located near the uphole end. The valve system includes a check valve to hold the applied pressure in the annular space between the mandrel and the element. Other types of inflatables known as External Casing Packers use fixed collars and reinforcement only on the ends of the element.

In the earlier designs, the inflation medium was drilling mud or other liquids. Inflating the element with such liquids had certain drawbacks. One problem was thermal effects that could cause a pressure reduction under the inflated element and a loss of seal. Another drawback was that damage to the element either from installation or during service in the well over a period of time could result in a tear or rupture of the element and a loss of seal as the fluid escaped, either slowly or virtually immediately depending on the nature of the failure in the element. While the valve system had provisions for avoiding overpressure, the risks to the integrity of the element were real and present and resulted in failures.

In an effort to improve inflatable performance, cement slurry was used as the inflation medium. The idea was that the slurry, in a pumpable condition, would be delivered into the annular space between the mandrel and the element and under pressure. The slurry would then set up with the hope that, once set up, the slurry, now in solid form would help to hold the seal of the packer even if the element experienced a failure. However introducing cement slurry created several new problems. First, there were added risks of getting the slurry through the various valves of the inlet assembly without fouling their operation. Second, the use of cement slurry required specialized equipment at the surface. Some applications, particularly offshore, created logistical problems in locating such equipment on platforms and created increased expense due to the logistical issues. Furthermore, when using cement slurry, time was of the essence in spotting and pumping the slurry behind the element. It was also important to quickly remove any excess slurry to avoid having to drill it out if it impeded later operations. As if all these issues were not enough of a concern, there was yet another downside to the use of the cement slurry. The slurry, upon setting, actually reduced in volume. This made the packer more likely to lose its sealing contact after it was set.

The prior art fluid inflatable packers are described in U.S. Pat. Nos. 4,897,139; 4,967,846 and 5,271,469. Cement inflatable packers are described in U.S. Pat. No. 5,738,171.

The present invention addresses the shortcomings of the past systems for inflation of the element and retention of the seal after inflation. The element is inflated with a fluid, as before. However, a layer is inserted in the annular space between the element and the mandrel that, upon contact with the inflating fluid absorbs the inflating fluid and expands so that the expanded volume of the fluid and the expanding layer is preferably as great as the volume of the two layers prior to absorption. The resulting advantage is retention of the seal despite a failure in the element as the expanding layer with the retained fluid provides the continuing sealing force. Furthermore, there is no volume loss after inflation as occurred in the prior design using cement slurry that could undermine the sealing force of the inflated element. Those and other advantages of the present invention will become more readily apparent to those skilled in the art from the description of the preferred embodiment, the drawings and the claims that appear below.

SUMMARY OF THE INVENTION

An inflatable that features a swelling layer is disclosed. The swelling layer can be made integral or attached to the element or it can be bonded or otherwise secured to the mandrel. Upon inflation with fluid, the element expands into sealing contact with a surrounding tubular or wellbore. The fluid is absorbed or otherwise interacts with the swelling layer so that, in a preferred embodiment, the total occupied volume of the swelling layer and fluid individually is retained after mixing with the swelling of the layer acting to hold the seal of the inflatable element even if a problem develops in the sealing element.

DETAILED DESCRIPTION OF THE PREFERRED EMBODIMENT

Figure 1:
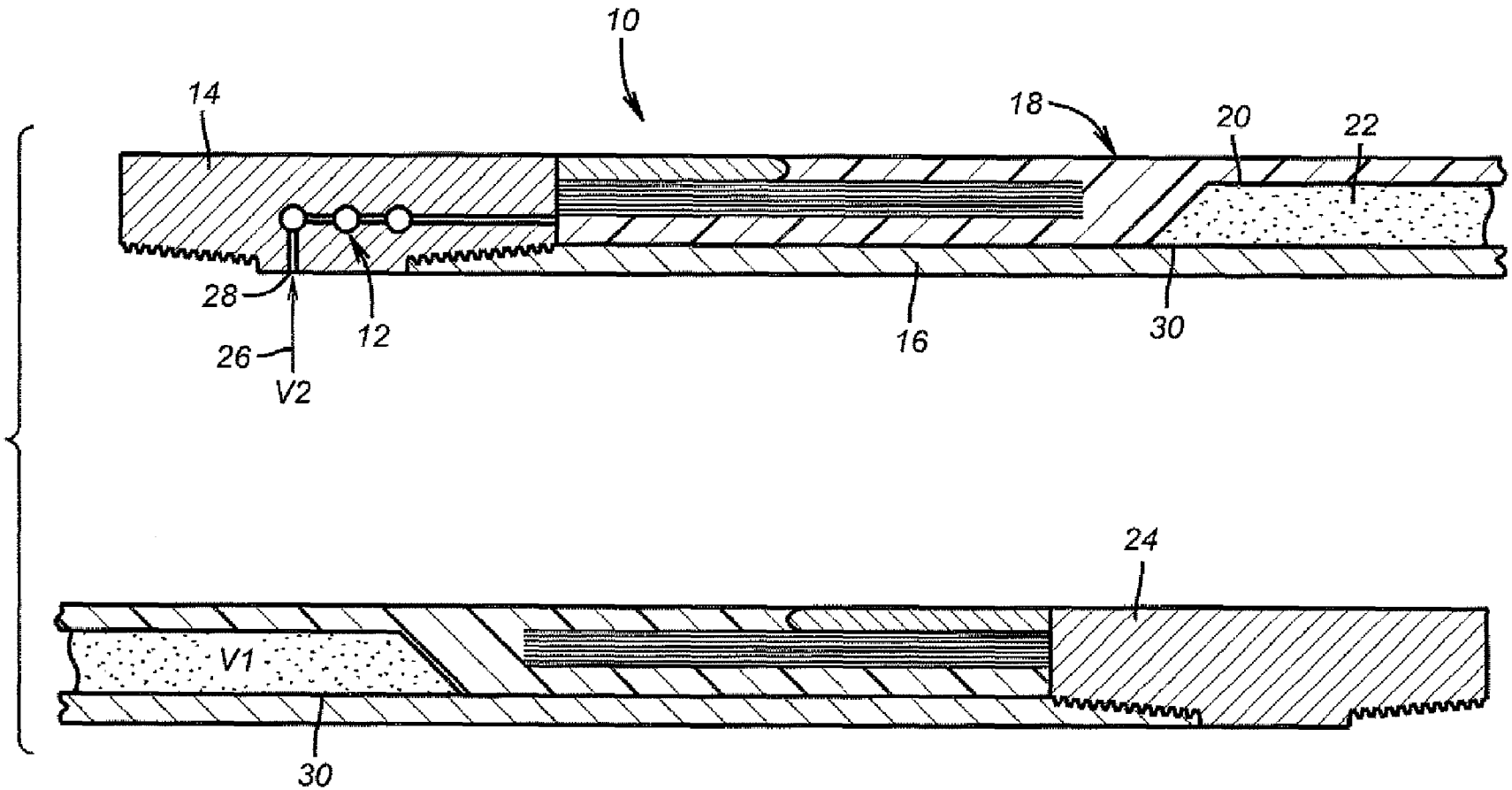
FIG. 1 is a sectional view of an inflatable having a swelling layer connected to the element and shown in the run in position.
Figure 4:
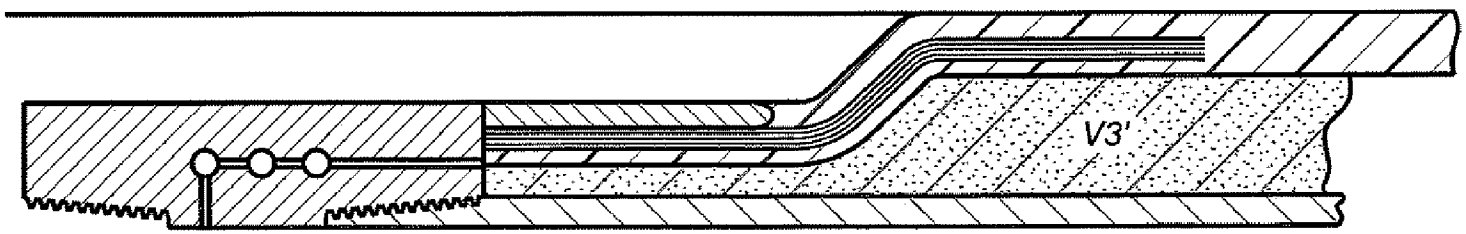
FIG. 4 is the view of FIG. 3 showing the activating fluid absorbed into the swelling material.

FIG. 1 schematically shows an inflatable packer 10 is section. It has a known inlet valve assembly 12 on a stationary collar 14 connected to mandrel 16. The inflatable element 18 has attached to an inner surface 20 a swelling layer 22. Schematically illustrated at the lower end of the element 18 is lower collar 24. Inflation fluid, shown schematically as arrow 26 is pumped into inlet 28. As shown in FIG. 1, the swelling layer has an initial volume V1. A predetermined volume V2 also schematically represented in FIG. 1 is pumped into inlet 28. The fluid volume is absorbed into the volume V1 of the swelling layer. In the preferred embodiment, the swelling layer 22 swells as it absorbs at least some of the fluid volume V2. In the preferred embodiment the final volume V3, shown in FIG. 4, is at least as large and preferably larger than the sum of V1 and V2 prior to mixing the inflation fluid, represented by arrow 26 with the swelling layer 22. The inflation fluid 26 first contacts the innermost end 30 facing mandrel 16 after the fluid is introduced through the valve assembly in the embodiment shown in FIG. 1.

Figure 2:
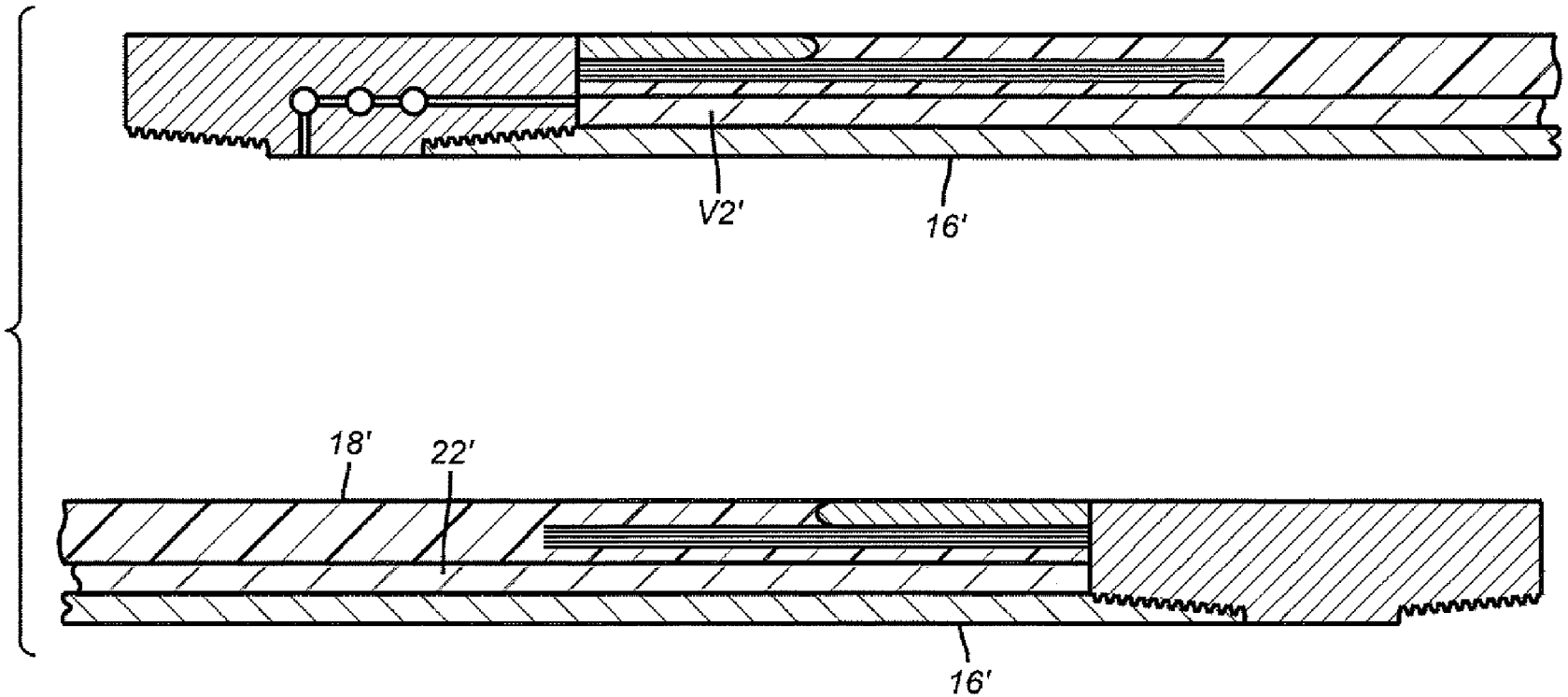
FIG. 2 is an alternative embodiment of FIG. 1 with the swelling layer separate from the element and shown in the ruin in position.

In FIG. 2, the swelling layer 22' is a separate layer from the element 18'. The swelling 22' layer can be bonded to the mandrel 16' or loosely mounted over it. The swelling layer in either embodiment can be a seamless tube or it can have a seam in a variety of orientations. Alternatively, the swelling layer may be in the form of a scroll with overlapping ends. It may also be a series of discrete pieces that are connected or abutting. In FIG. 1 the swelling layer 22 can be integral to the element 18 or be a discrete layer bonded or otherwise connected to it.

Figure 3:
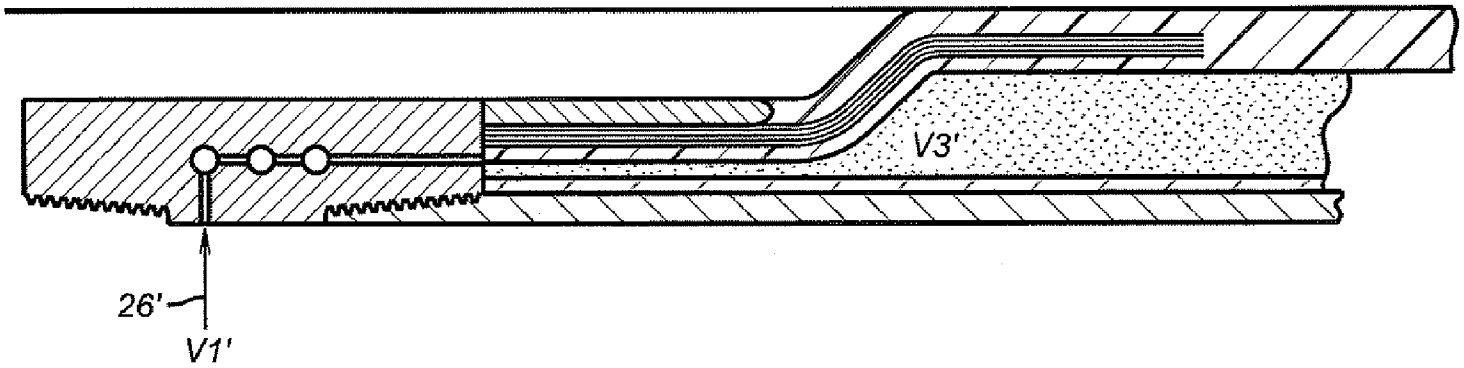
FIG. 3 is the view of FIG. 2 in the inflated position.

FIG. 3 illustrates the fluid 26' entering between the element 18' and the swelling layer 22'. Here again, the final volume V3' should be at least equal to the initial volume V1' of the fluid and V2' of the swelling layer 22' before inflation.

In the preferred embodiment the swelling layer 22 or 22' is EPDM but other materials such as natural rubber or brombutyl rubber. These materials, when exposed to a hydrocarbon as the inflating fluid will swell and retain the inflating fluid and meet the volume requirements described above. As a result, an inflated element will continue to hold a seal after inflation. The swelling action, which goes on over time actually enhances the sealing force to the extent V3 exceeds the sum of V1 and V2. Additionally, if the element 18 or 18' develops a leak or tear, the sealing force will remain as the inflation fluid will be tied up in the swelled layer 22 or 22' and preferably the consistency of the swelled layer will be strong enough to hold the damaged element in sealing contact in the wellbore.

Other options for the swelling layer 22 or 22' include using swelling clay such as bentonite that expands dramatically in the presence of water as the inflation fluid and then hardens. To the extent such a material meets the volume criteria it could be used in an inflatable. The hardened clay could also serve to retain the inflation fluid and could be rigid enough to help retain a seal in the presence of a failure of the element 18 or 18'. Alternatively the swelling layer 22 or 22' can include a fabric that absorbs liquid and expands dramatically. A combination of the fabric and clay such as bentonite is possible as is the further addition of an EPDM or other material that swells in the presence of oil.

Oil based drilling fluids contain a mixture of oil and water and can be used as the inflation medium. Typically the drilling fluid mixture might be composed of 60% oil and 40% water with solids to increase the density the fluid. If the inflation fluid is a mixture of oil and water then a clay such as bentonite or fabric can swell with the water phase and the EPDM or a rubber can swell with the oil.

Those skilled in the art will now appreciate that the reliability of inflatable packers is improved through the use of a swelling material that ties up the inflation fluid without suffering a net volume loss. Instead, the swelling enhances the sealing grip and helps to retain such grip even if there are changes in thermal conditions downhole or a failure of the element. Various configurations of sealing element and swelling layer may be used. While the preferred material EPDM can be used other swelling materials when exposed to a variety of fluids can be used. Alternatively, materials that swell in response to heat, current, fields of various types or as a result of reactions of various types can also be used. As long as the volume requirements are met and the resulting layer is strong enough to retain the sealing load despite a failure in the element, the material or combination of materials can be used. Ideally, the inflation medium, whether liquid or gas, is retained by the swelling layer despite an element failure.

The above description is illustrative of the preferred embodiment and many modifications may be made by those skilled in the art without departing from the invention whose scope is to be determined from the literal and equivalent scope of the claims below:

We claim:

1. A method of operating a wellbore inflatable packer, comprising:

providing an inflatable element on a rigid mandrel to define an annular space therebetween and an inlet further comprising a check valve assembly to said annular space from within said mandrel;

providing in said annular space, at a spaced relation to said inlet, a material that grows in volume in response to fluid delivered into said annular space;

delivering fluid under pressure to said annular space in sufficient volume to inflate the inflatable element to a sealing relation with the surrounding wellbore while retaining the pressure with said check valve assembly;

enhancing the seal against the wellbore already obtained from said delivering of fluid by a volume enlargement of said material.

2. The method of claim 1, further comprising:

making said material have an initial volume $V_1$ and the delivered fluid under pressure to said annular space an initial volume $V_2$;

delivering volume $V_2$ to said annular space;

making the total volume of the delivered fluid and said material at least about the sum of volumes $V_1$ and $V_2$.

3. The method of claim 1, further comprising:

making said material retain at least a portion of said delivered fluid under pressure in the event of malfunction of said inflatable element.

4. The method of claim 1, further comprising:

allowing said material to swell when contacted by said delivered fluid under pressure.

5. The packer of claim 1, further comprising:

allowing said material to swell in the presence of at least one of water and a hydrocarbon.

6. The method of claim 3, further comprising:

allowing said material to retain the seal of said inflatable element, after inflation, despite a malfunction of said sealing element.

7. The method of claim 5, further comprising:

allowing said material to swell in the presence of both water and a hydrocarbon.

8. The method of claim 1, further comprising:

securing said material to said inflatable element.

9. The method of claim 1, further comprising:

securing said material to said mandrel.

10. The method of claim 1, further comprising:

securing said material to neither said mandrel nor said inflatable element.

11. The method of claim 1, further comprising:

forming said material as a sleeve.

12. The method of claim 11, further comprising:

making said sleeve seamless.

13. The method of claim 1, further comprising:

using a swelling clay as said material.

14. The method of claim 1, further comprising:

using at least one of ethylene propylene diene monomer (EPDM), natural rubber and brombutyl rubber as said material.

15. The method of claim 3, further comprising:

making said material have an initial volume $V_1$ and the delivered fluid under pressure to said annular space an initial volume $V_2$;

delivering volume $V_2$ to said annular space;

making the total volume of said delivered fluid and said material at least about the sum of volumes $V_1$ and $V_2$.

16. The method of claim 15, further comprising:

allowing said material to swell when contacted by said delivered fluid under pressure.

17. The method of claim 16, further comprising:

allowing said material to swell in the presence of at least one of water and a hydrocarbon.

18. The method of claim 17, further comprising:

allowing said material to retain the seal of said sealing element, after inflation, despite a malfunction of said sealing element.

19. The method of claim 18, further comprising:

forming said material as a sleeve.

20. The method of claim 19, further comprising:

using at least one of EPDM, natural rubber and brombutyl rubber as said material.

* * * * *